US009096061B2

(12) United States Patent
Sasaki

(10) Patent No.: US 9,096,061 B2
(45) Date of Patent: Aug. 4, 2015

(54) DROPLET DISCHARGE HEAD, AND IMAGE-FORMING APPARATUS

(71) Applicant: Takafumi Sasaki, Atsugi (JP)

(72) Inventor: Takafumi Sasaki, Atsugi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/468,599

(22) Filed: Aug. 26, 2014

(65) Prior Publication Data

US 2015/0062255 A1 Mar. 5, 2015

(30) Foreign Application Priority Data

Sep. 5, 2013 (JP) ..... 2013-183754
Jun. 20, 2014 (JP) ..... 2014-127398

(51) Int. Cl.
*B41J 2/045* (2006.01)
*B41J 2/14* (2006.01)
*B41J 2/18* (2006.01)

(52) U.S. Cl.
CPC ..... *B41J 2/14233* (2013.01); *B41J 2/14201* (2013.01); *B41J 2/18* (2013.01)

(58) Field of Classification Search
CPC ..... B41J 2/18; B41J 2/14201; B41J 2/14274
See application file for complete search history.

(56) References Cited

U.S. PATENT DOCUMENTS

2007/0008388 A1 1/2007 Yamaguchi et al.
2008/0111862 A1 5/2008 Sasaki
2008/0117262 A1* 5/2008 Mori et al. ..... 347/65
2008/0238980 A1 10/2008 Nagashima et al.
2009/0009569 A1 1/2009 Sasaki
2009/0102907 A1 4/2009 Yamanaka et al.
2012/0092417 A1* 4/2012 Kumagai ..... 347/47
2013/0176363 A1 7/2013 Sasaki
2014/0028756 A1 1/2014 Nishimura et al.
2014/0036007 A1 2/2014 Sasaki
2014/0071199 A1 3/2014 Tajima et al.
2014/0078221 A1 3/2014 Sasaki et al.

FOREIGN PATENT DOCUMENTS

JP 6-143602 5/1994
JP 2002-254643 9/2002
JP 2006-88493 4/2006
JP 4855992 11/2011
JP 2012-61717 3/2012

* cited by examiner

*Primary Examiner* — Geoffrey Mruk
(74) *Attorney, Agent, or Firm* — Cooper & Dunham LLP

(57) ABSTRACT

A droplet discharge head includes a plurality of pressure chambers which communicate with a plurality of nozzles which discharge droplets, respectively; at least one common supply passage which supplies liquid to the pressure chambers; at least one common return passage which communicates with the pressure chambers and to which a part of the liquid in the pressure chambers is returned; and a plurality of energy-generating elements which generate pressure in the pressure chambers, wherein the droplet discharge head circulates liquid supplied from the common supply passage to the pressure chambers to the common return passage and discharges droplets from the nozzles when pressure is generated in the pressure chambers by the energy-generating elements, and the common supply passage and the common return passage are arranged on the same side with respect to the pressure chambers.

10 Claims, 11 Drawing Sheets

DROPLET DISCHARGE HEAD, AND IMAGE-FORMING APPARATUS

CROSS-REFERENCE TO RELATED APPLICATIONS

The present application is based on and claims priority from Japanese Patent Application Numbers 2013-183754, filed Sep. 5, 2013, and 2014-127398, filed Jun. 20, 2014, the disclosures of which are hereby incorporated by reference herein in their entireties.

BACKGROUND

The present invention relates to a droplet discharge head which circulates a recording liquid in a pressure chamber, and discharges droplets of the recording liquid from a nozzle hole, and an image-forming apparatus equipped with the droplet discharge head.

Generally, an image-forming apparatus such as a printer, a fax machine, a copier, or a multifunction peripheral thereof is equipped with a droplet discharge head for ink-jet recording, or the like. A droplet discharge head performs recording by discharging a recording liquid (ink) toward sheets of paper (which are not limited to paper, but include OHP (overhead projector) sheets, or the like) from a nozzle hole thereof. By using such a droplet discharge head, it is possible to record a high-definition color image at high speed.

The droplet discharge head generally has a plurality of nozzle arrays, and a plurality of pressure chambers corresponding to the nozzle arrays. Generally, the pressure chambers communicate with a common recording liquid storage (common supply passage) which has a comparatively large capacity.

By selectively applying energy to the pressure chambers, the recording liquid is discharged from nozzle holes, and an arbitrary image is obtained on demand. As an energy-applying medium, a piezoelectric element and a heater are used.

In recent years, output of higher-quality images at higher speed has been requested. In order to realize higher-quality images, the number of nozzles and nozzle density have increased. This has resulted in each interval between the pressure chambers becoming narrower. Additionally, the frequency of applied energy tends to be higher. On the other hand, in order to provide higher speed output, lengthening of the head has been proposed, and in recent years, a so-called line-type printer which covers an entire width range of the recording medium has become common.

Additionally, such a droplet discharge technique is widely applied to not only image formation, but also to so-called three-dimensional shaping systems and bioscience fields, such as tissue engineering, or the like, and is used for the purpose of discharge of not only ink, but also various recording liquids.

In addition, a droplet discharge head is known which circulates a recording liquid (ink) in a pressure chamber, generates pressure in the pressure chamber by a piezoelectric element, and discharges the recording liquid in the pressure chamber from a nozzle hole. The droplet discharge head has a common supply passage and a common return passage on an upstream side and a downstream side of the pressure chamber, along a circulation direction of the recording liquid, and circulates the recording liquid in the pressure chamber by generating a difference in pressure between the common supply passage and the common return passage (see Japanese Patent No. 4617798, and Japanese Patent No. 3097718). In such a droplet discharge head, the recording liquid in the pressure chamber always flows, and therefore, it is possible to prevent materials included in the recording liquid from being deposited.

Furthermore, as an energy-generating element, although it is an example of a droplet discharge head using a heating resistor, on a side close to an upstream side of a pressure chamber along a circulation direction of a recording liquid, a structure in which a circulation passage on an upstream side and a circulation passage on a downstream side communicate with an ink reservoir layer is disclosed (see Japanese Patent Application Publication No. 2002-254643).

In Japanese Patent Application Publication No. 2002-254643, the circulation passages are formed inside of a supporting plate, and a passage-forming base plate is formed of an alumina-glazed base plate, a single crystal silicon, metal, or the like by a photolithography method, and therefore, it is possible to perform micro-fabrication.

SUMMARY

However, in Japanese Patent No. 4617798, and Japanese Patent No. 3097718, the common supply passage, pressure chamber, and common return passage are arranged in a planar manner. That is, along the circulation direction of the recording liquid, the common supply passage and the common return passage are arranged on the upstream side and the downstream side of the pressure chamber, respectively, and the common supply passage, pressure chamber, and common return passage are located on approximately the same plane. As a result, there is a problem in that the droplet discharge head becomes larger in a longitudinal direction of the pressure chamber.

Additionally, in the droplet discharge head having the above structure, there is a problem in that a flow direction of the recording liquid easily reverses. That is, it is preferable that, in particular, while the head is driven (while a piezoelectric element is driven, and droplets are discharged from a nozzle), when the recording liquid is supplied from a side of the common supply passage, and flows to a side of the common return passage, a flow direction of the recording liquid is always constant. When the above flow of the recording liquid is reversed, that is, when the recording liquid flows from the side of the common return passage to the side of the common supply passage, the recording liquid hits against the pressure chamber, and an unintentional loss of pressure occurs.

Additionally, by supplying the recording liquid from the side of the common supply passage and returning the recording liquid from the side of the common return passage, refill periods of the recording liquid are superimposed, and there is a possibility of an occurrence of an unexpected discharge failure.

In order to prevent the above, Japanese Patent No. 4617798 discloses that fluid resistance is enhanced by providing a narrow portion in a part of the pressure chamber, and the flow direction of the recording liquid is maintained to be constant. However, in Japanese Patent No. 4617798, a refill is performed from a common passage (for example, common return passage) on a side close to a nozzle hole, and a conduit which damps a refill vibration is short, which is largely affected by the refill vibration, and is not preferable.

Additionally, in Japanese Patent Application Publication No. 2002-254643, the supporting plate in which the circulation passages are formed is large in size, and therefore, costly components and production methods are used, which is not realistic. That is, in Japanese Patent Application Publication No. 2002-254643, the following circulation passages are provided such that metals such as aluminum, SUS (stainless steel), and the like are used, and a groove has the depth of equal to or more than 1 mm. In the circulation passages having such a size, naturally, fluid resistance is much smaller than in the pressure chamber. In this case, pressure generated by the energy-generating element runs away to a side of the circulation passages, the pressure in the pressure chamber does not increase, and efficiency of discharge lowers prominently.

An object of the present invention is to provide a droplet discharge head which is a type in which a circulating flow of liquid is generated in a pressure chamber and prevents a head body from becoming larger in size, and an image-forming apparatus equipped with the droplet discharge head.

In order to achieve the above object, an embodiment of the present invention provides: a droplet discharge head comprising a plurality of pressure chambers which communicate with a plurality of nozzles which discharge droplets, respectively; at least one common supply passage which supplies liquid to the pressure chambers; at least one common return passage which communicates with the pressure chambers and to which a part of the liquid in the pressure chambers is returned; and a plurality of energy-generating elements which generate pressure in the pressure chambers, wherein the droplet discharge head circulates liquid supplied from the common supply passage to the pressure chambers to the common return passage and discharges droplets from the nozzles when pressure is generated in the pressure chambers by the energy-generating elements, and the common supply passage and the common return passage are arranged on the same side with respect to the pressure chambers.

DETAILED DESCRIPTION OF THE PREFERRED EMBODIMENTS

Hereinafter, examples according to embodiments of the present invention will be explained with reference to the drawings. In each of Examples 1 to 4, a droplet discharge head according to an embodiment of the present invention will be explained. And in Example 5, an image-forming apparatus according to an embodiment of the present invention will be explained.

Embodiments

Example 1

Figure 1:
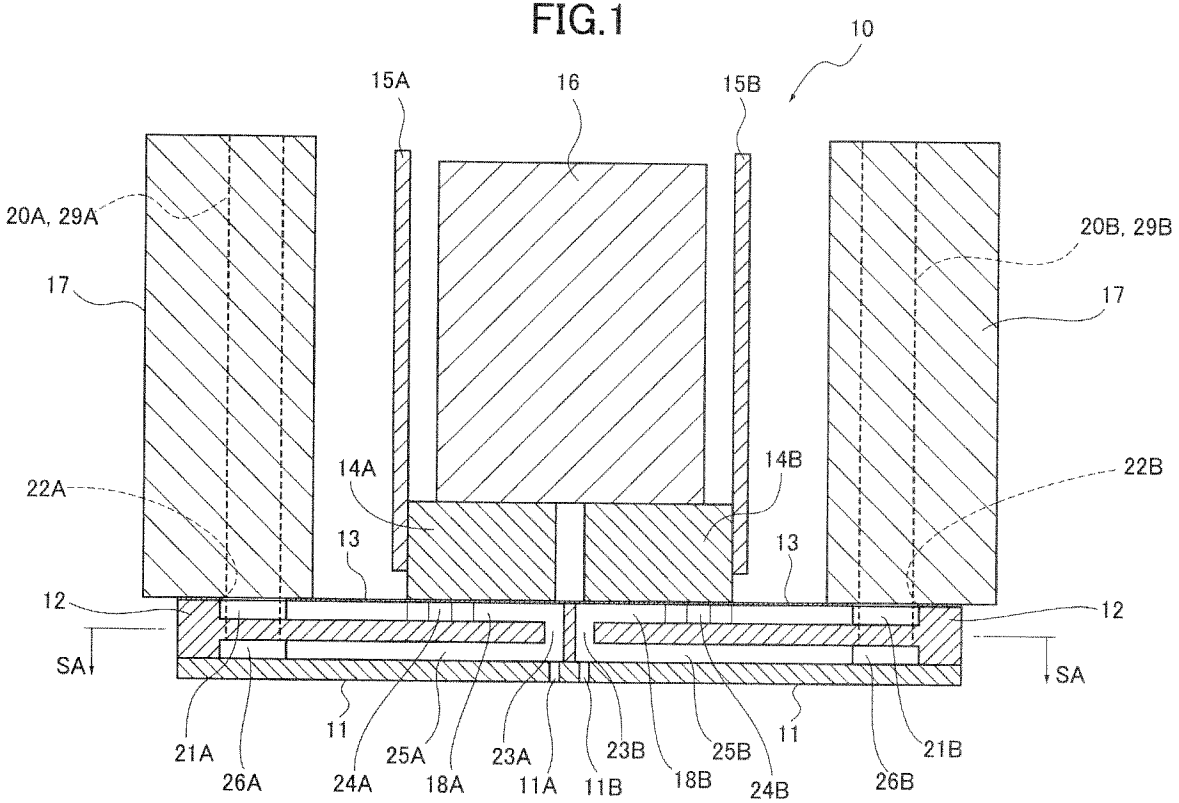
FIG. 1 is a longitudinal sectional view of a droplet discharge head of Example 1.

FIG. 1 is a longitudinal sectional view of a droplet discharge head of Example 1. A droplet discharge head 10 of the present example includes a nozzle plate 11, a passage-forming base plate 12 which is provided on the nozzle plate 11, a vibrating plate 13 which is provided on an upper side of the passage-forming base plate 12, and a plurality of layered-type piezoelectric elements (PZT) 14A and a plurality of layered-type piezoelectric elements (PZT) 14B which are provided on the vibrating plate 13. Additionally, the droplet discharge head 10 includes flexible base plates 15A, 15B which are provided on both sides of the piezoelectric elements 14A, 14B, respectively, and a base member 16 which is provided on the piezoelectric elements 14A, 14B. Furthermore, the droplet discharge head 10 includes a housing 17, and the housing 17 holds the passage-forming base plate 12. The housing 7 contains the piezoelectric elements 14A, 14B, flexible base plates 15A, 15B, base member 16, and the like within. In the present example, the piezoelectric elements 14A, 14B constitute energy-generating elements. In addition, in the nozzle plate 11, a plurality of nozzle holes 11A and a plurality of nozzle holes 11B are formed as nozzles.

Figure 2:
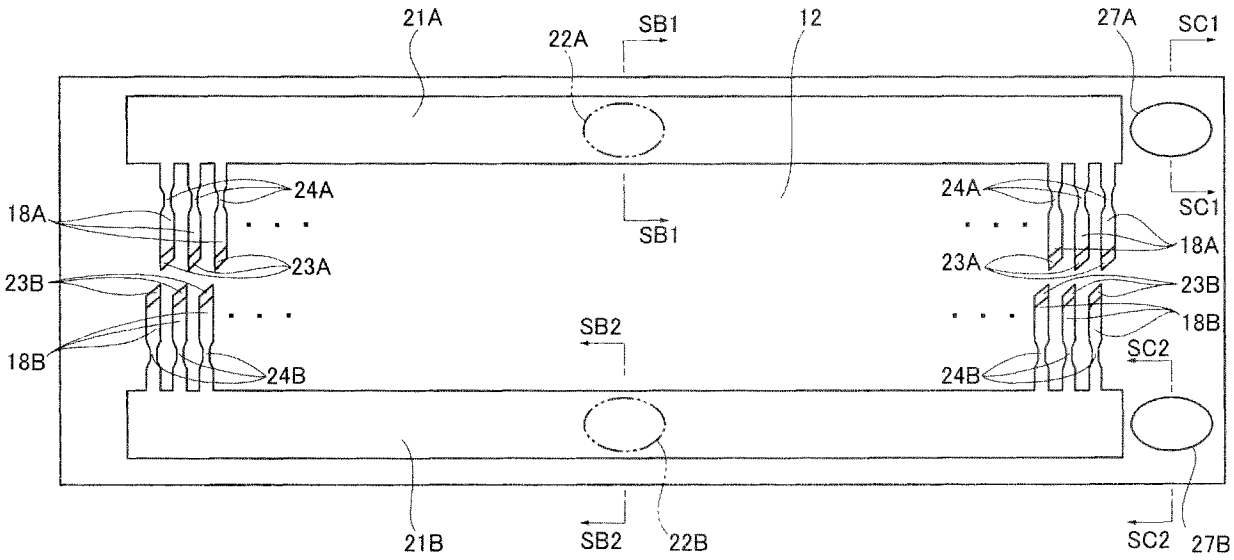
FIG. 2 is a view of a passage-forming base plate in FIG. 1 as seen from above.
Figure 3:
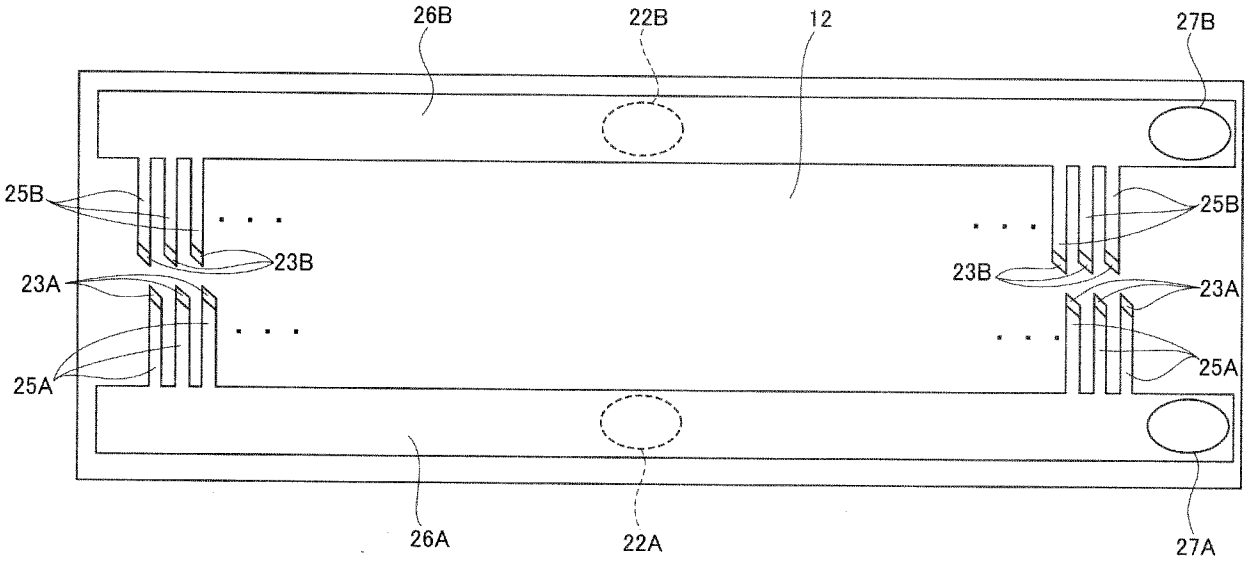
FIG. 3 is a view of the passage-forming base plate in FIG. 1 as seen from below.

FIG. 2 is a view of the passage-forming base plate 12 of FIG. 1 as seen from above (that is, as seen from a side of the vibrating plate 13). FIG. 3 is a view of the passage-forming base plate 12 of FIG. 1 as seen from below (that is, as seen from a side of the nozzle plate 11).

As shown in FIGS. 2 and 3, the passage-forming base plate 12 has a rectangular flat plate shape in a top view or a bottom view. In an upper surface of the passage-forming base plate 12 (a surface facing the vibrating plate 13), a plurality of pressure chambers 18A and a plurality of pressure chambers 18B are formed. Additionally, in the upper surface of the passage-forming base plate 12, at both ends on long sides (both of upper and lower ends in the drawing), a common supply passage 21A and a common supply passage 21B are formed, respectively. Each of the pressure chambers 18A, 18B is in a groove shape, and an upper portion of each of the pressure chambers 18A, 18B is covered with the vibrating plate 13 (see FIG. 1). Additionally, each of the common supply passages 21A, 21B is in a groove shape, and an upper portion of each of the common supply passages 21A, 21B is covered with the vibrating plate 13 or a bottom surface of the housing 17 (see FIG. 1).

Each of the common supply passages 21A, 21B extends straight along a longitudinal direction of the passage-forming base plate 12, and is in a belt-like shape having a predetermined width, and both ends of each of the common supply passages 21A, 21B are close to reaching both short sides of the passage-forming base plate 12, respectively. Approximately in the center of the longitudinal direction of the common supply passage 21A, that is, in the bottom surface of the housing 17 which covers the upper portion of the common supply passage 21A, a supply hole 22A is formed. The supply hole 22A communicates with a recording liquid supply passage 20A which is provided in the housing 17. Additionally, approximately in the center of the longitudinal direction of the common supply passage 21B, that is, in the bottom surface of the housing 17 which covers the upper portion of the common supply passage 21B, a supply hole 22B is formed.

The supply hole 22B communicates with a recording liquid supply passage 20B which is provided in the housing 17.

Note that in FIG. 1, the recording liquid supply passage 20A connects to a recording liquid tank (not shown), and liquid (which is ink, or the like, for example, and hereinafter referred to as a recording liquid) in the recording liquid tank is supplied to the recording liquid supply passage 20A. The recording liquid supply passage 20B also connects to the recording liquid tank, and ink in the recording liquid tank is supplied to the recording liquid supply passage 20B.

As shown in FIG. 2, the pressure chambers 18A are provided along the common supply passage 21A, and the pressure chambers 18B are provided along the common supply passage 21B. Each of the pressure chambers 18A communicates with the common supply passage 21A, and each of the pressure chambers 18B communicates with the common supply passage 21B. Note that, for example, in FIG. 2, three pressure chambers 18A are shown at each of right and left ends of the common supply passage 21A, and other pressure chambers 18A are omitted. Likewise, three pressure chambers 18B are shown at each of right and left ends of the common supply passage 21B, and other pressure chambers 18B are omitted.

Each of the pressure chambers 18A is formed to face each of the pressure chambers 18B, and each of the pressure chambers 18B is formed to face each of the pressure chambers 18A. Each of the pressure chambers 18A is formed to be deviated from each of the pressure chambers 18B entirely, and the pressure chambers 18A and the pressure chambers 18B are arranged in a zigzag fashion in two lines. The same number of pressure chambers 18A and pressure chambers 18B are provided.

In FIG. 2, an end of each of the pressure chambers 18A is obliquely cut from the lower left to upper right. Likewise, an end of each of the pressure chambers 18B is obliquely cut from the lower left to upper right. At the obliquely-cut end of each of the pressure chambers 18A, each of communication passages 23A is formed. Likewise, at the obliquely-cut end of each of the pressure chambers 18B, each of communication passages 23B is formed. The communication passages 23A, 23B will be explained in detail later.

In the present example, narrow portions (fluid resistance portions) 24A, 24B are provided in halfway positions of the pressure chambers 18A, 18B, respectively. The narrow portions 24A, 24B will be explained in detail later.

In a lower surface of the passage-forming base plate 12 (a surface facing the nozzle plate 11), as shown in FIG. 3, a plurality of return passages 25A and a plurality of return passages 25B are formed at both ends on short sides (both of right and left ends in the drawing), respectively. Additionally, in the lower surface of the passage-forming base plate 12, at both ends on long sides (both of upper and lower ends in the drawing), a common return passage 26A and a common return passage 26B are formed, respectively. Each of the return passages 25A, 25B is in a groove shape, and a lower portion of each of the return passages 25A, 25B is covered with the nozzle plate 11 (see FIG. 1). Additionally, each of the common return passages 26A, 26B is in a groove shape, and a lower portion of each of the common return passages 26A, 26B is covered with the nozzle plate 11 (see FIG. 1). Each of the return passages 25A communicates with the common return passage 26A, and each of the return passages 25B communicates with the common return passage 26B.

Note that, for example, in FIG. 3, three return passages 25A are shown at each of right and left ends of the common return passage 26A, and other return passages 25A are omitted. Likewise, three return passage 25B are shown at each of right and left ends of the common return passage 26B, and other return passages 25B are omitted.

Each of the common return passages 26A, 26B extends straight along a longitudinal direction of the passage-forming base plate 12, and is in a belt-like shape having a predetermined width, and both ends of each of the common return passages 26A, 26B are close to reaching both short sides of each of the passage-forming base plate 12, respectively. Note that the length of each of the common return passages 26A, 26B is longer than that of each of the common supply passages 21A, 21B.

At an end of one side (right end in FIG. 3) of the common return passage 26A, in an upper portion thereof a return hole 27A is formed, and the return hole 27A communicates with a recording liquid supply passage 29A (see FIG. 1) which is provided in the housing 17. Additionally, at an end of one side (right end in FIG. 3) of the common return passage 26B, in an upper portion thereof a return hole 27B is formed, and the return hole 27B communicates with a recording liquid supply passage 29B (see FIG. 1) which is provided in the housing 17.

Each of the return passages 25A is formed to face each of the return passages 25B, and each of the return passages 25B is formed to face each of the return passages 25A. Each of the return passages 25A is formed to be deviated from each of the return passages 25B entirely, and the return passages 25A and the return passages 25B are arranged in a zigzag fashion in two lines. The return passages 25A and the return passages 25B are provided by the same number.

Note that directly under the pressure chambers 18A, the return passages 25A are provided, and directly under the pressure chambers 18B, the return passages 25B are provided.

In FIG. 3, an end of each of the return passages 25A is obliquely cut from upper left to lower right. Likewise, an end of each of the return passages 25B is obliquely cut from upper left to lower right. At the obliquely-cut end of each of the return passages 25A, each of the communication passages 23A is formed. Likewise, at the obliquely-cut end of each of the return passages 25B, each of the communication passages 23B is formed.

Figure 4:
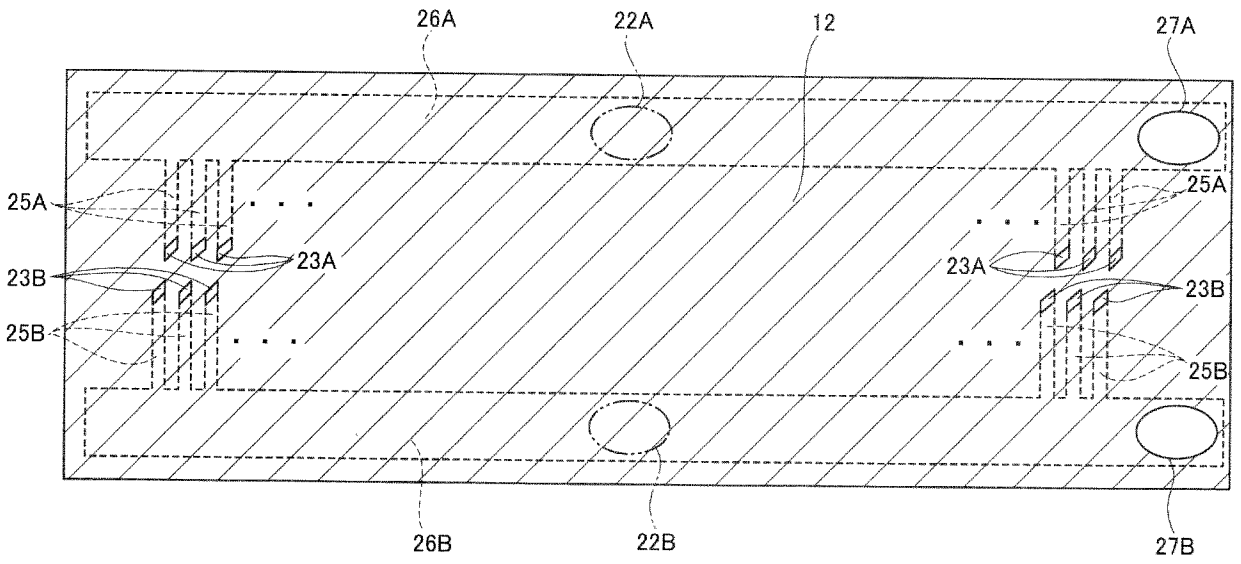
FIG. 4 is a cross-sectional view along line SA-SA of FIG. 1.

FIG. 4 is a cross-sectional view along line SA-SA of FIG. 1. As shown in the drawing, in the passage-forming base plate 12, the communication passages 23A having parallelogram cross-sectional shapes are formed such that one side of each of the communication passages 23A connects to the end of each of the return passages 25A, and the other side of each of the communication passages 23A connects to an end of each of the pressure chambers 18A. Likewise, the communication passages 23B having parallelogram cross-sectional shapes are formed such that one side of each of the communication passages 23B connects to the end of each of the return passages 25B, and the ether side of each of the communication passages 23B connects to an end of each of the pressure chambers 18B.

Figure 5:
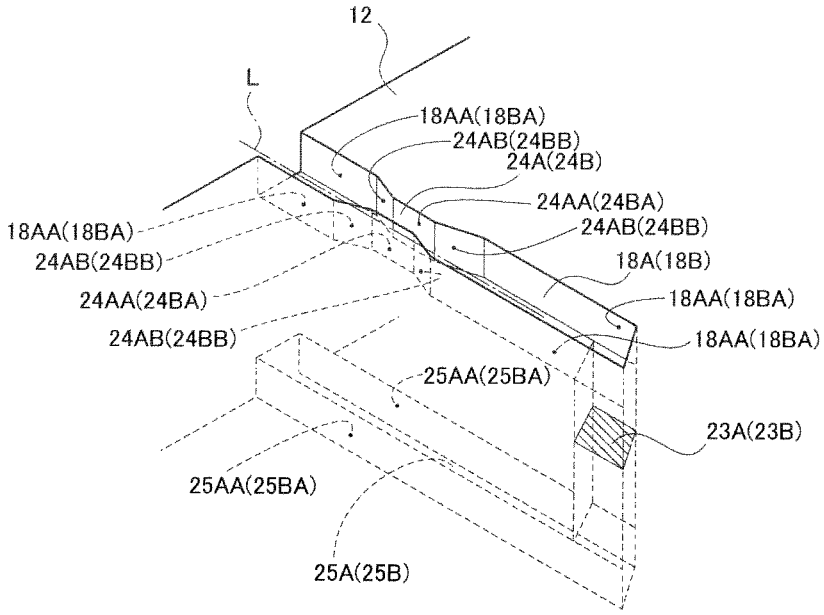
FIG. 5 is a perspective view showing a pressure chamber, a return passage, and a communication passage.

FIG. 5 is a view three-dimensionally showing each one of the pressure chambers 18A (18B), the return passages 25A (25B), and the communication passages 23A (23B) as an example. The pressure chambers 18A (18B) and the return passages 25A (25B) are connected by the communication passages 23A (23B).

Referring to FIG. 5, the pressure chamber 18A (18B), the narrow portion 24A (24B), and the return passage 25A (25B) will be explained.

As shown in FIG. 5, the pressure chamber 18A includes the narrow portion 24A, and side walls 18AA which face each other. The narrow portion 24A is provided in the halfway position of the pressure chamber 18A. The narrow portion 24A includes protruding walls 24AA which face each other and connecting walls 24AB which face each other. The protruding walls 24AA protrude further to a center axis L than the side walls 18AA of the pressure chamber 18A. The connecting walls 24AB are provided on both sides of the protruding walls 24AA and connect the protruding walls 24AA and the side walls 18AA. A portion where the protruding walls 24AA face each other is narrower than other portions (portions where the side walls 18AA face each other).

Likewise, the pressure chamber 18B includes the narrow portion 24B, and side walls 18BA which face each other. The narrow portion 24B is provided in the halfway position of the pressure chamber 18B. The narrow portion 24B also includes protruding walls 24BA which face each other and connecting walls 24BB which face each other. The protruding walls 24BA protrude further than the side walls 18BA. The connecting walls 24BB are provided on both sides of the protruding walls 24BA, and connect the protruding walls 24BA and the side walls 18BA.

Additionally, in a halfway position of the return passage 25A, something like the above narrow portion is not provided, the return passage 25A includes side walls 25AA which face each other, and the side walls 25AA are arranged in parallel. Likewise, in a halfway position of the return passage 25B, something like the above narrow portion is not provided, the return passage 25B includes side walls 25BA which face each other, and the side walls BA are arranged in parallel.

Additionally, as shown in FIG. 5, the end of the pressure chamber 18A (18B) is obliquely cut, and the end of the return passage 25A (25B) is obliquely cut. The communication passage 23A is provided to connect the end of the pressure chamber 18A and the end of the return passages 25A, and the communication passage 23B is provided to connect the end of the pressure chamber 18B and the end of the return passage 25B.

Via the communication passage 23, the pressure chambers 18A also communicate with the nozzle holes 11A. Likewise, via the communication passage 23B, the pressure chambers 18B also communicate with the nozzle holes 11B. (See FIG. 1)

Figure 6:
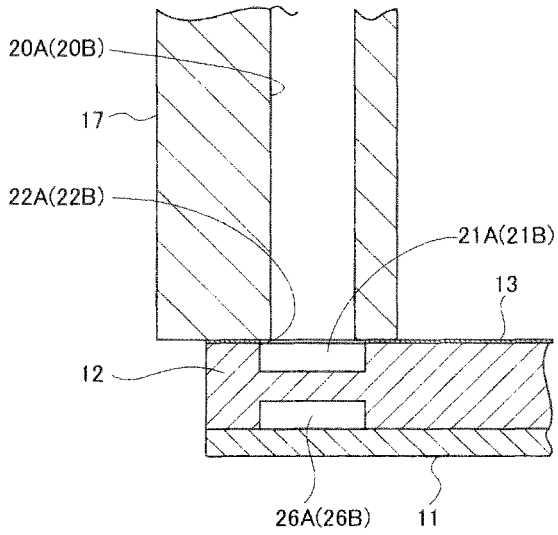
FIG. 6 is a view showing a cross-section along line SB1-SB1, or a cross-section along line SB2-SB2 of FIG. 2.

FIG. 6 shows a cross-section along line SB1-SB1 of FIG. 2 (cross-section in the vicinity of the supply hole 22A of the common supply passage 21A including the housing 17), or a cross-section along line SB2-SB2 of FIG. 2 (cross-section in the vicinity of the supply hole 22B of the common supply passage 21B including the housing 17). As shown in the drawing, supply holes 22A, 22B formed at the upper portions of the common supply passages 21A, 22B communicate with the recording liquid supply passages 20A, 20B of the housing 17, respectively.

Figure 7:
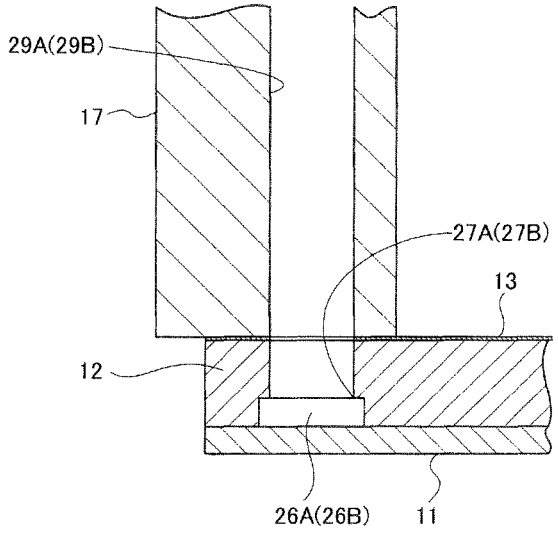
FIG. 7 is a view showing a cross-section along line SC1-SC1, or a cross-section along line SC2-SC2 of FIG. 2.

FIG. 7 shows a cross-section along line SC1-SC1 of FIG. 2 (cross-section in the vicinity of the return hole 27A of the common return passage 26A including the housing 17), or a cross-section along line SC2-SC2 of FIG. 2 (cross-section in the vicinity of the return hole 27B of the common return passage 26B including the housing 17). As shown in the drawing, the return holes 27A, 27B formed at the upper portions (a part of the passage-forming base plate 12) of the common return passages 26A, 26B communicate with the recording liquid return passages 29A, 29B of the housing 17, respectively.

In the droplet discharge head 10 having the above structure, the passage-forming base plate 12 is constituted of a silicon wafer, and the common supply passages 21A, 21B, the pressure chambers 18A, 18B, the return passages 25A, 25B, and the common return passages 26A, 26B are formed by an anisotropic etching using a KOH (potassium hydroxide) water solution. And the nozzle plate 11 and the vibrating plate 13 are formed by a nickel electroforming process.

In the present example, the droplet discharge head 10 is a face-shooter type droplet discharge head in which directions of main deformation of the piezoelectric elements 14A, 14B and discharge of droplets (ink droplets) from the nozzle holes 11A, 11B are the same. In such a droplet discharge head, a joint of the nozzle plate 11 and the vibrating plate 13 with the passage-forming base plate 12 is easy, and it has become mainstream in recent years.

In the present example, the piezoelectric elements 14A, 14B are formed by dicing, and arranged next to each other at intervals of 300 dpi (dots per inch), respectively, and the piezoelectric elements 14A, 14B are arranged oppositely in two lines. The nozzle holes 11A, 11B are arranged next to each other at intervals of 150 dpi, respectively, and the nozzle holes 11A, 11B are arranged in a zigzag fashion in two lines. And therefore, users can obtain 300-dpi resolution at one scanning.

The pressure chambers 18A, 18B are communicated with the return passages 25A, 25B by the communication passages 23A, 23B, respectively. The communication passages 23A, 23B can be formed by etching a base plate more deeply by an ICP (Inductively-Coupled Plasma) etching, for example.

Next, operation of the droplet discharge head 10 of the present example will be explained.

In FIG. 1, the piezoelectric elements 14A, 14B are bonded to the base member 16. An arbitrary drive waveform is applied to the piezoelectric elements 14A, 14B via the flexible base plate 15A, 15B by a not-shown electric circuit and control system. The piezoelectric elements 14A, 14B are deformed by the applied the drive waveform, and via the vibrating plate 13, energy is given to recording liquids in the pressure chambers 18A, 18B.

Upon receiving the energy, recording liquids in the pressure chambers 18A, 18B are discharged from the nozzle holes 11A, 11B. The recording liquids in the pressure chambers 18A, 18B are reduced by the discharge from the nozzle holes 11A, 11B, however, recording liquids for an amount corresponding to the reduced recording liquids are appropriately supplied via the recording liquid supply passages 20A, 20B and the common supply passages 21A, 21B.

In this case, in the present example, the narrow portions (fluid resistance portions) 24A, 24B are provided in the halfway positions of the pressure chambers 18A, 18B, and therefore, flows of the recording liquids in the pressure chambers 18A, 18B become stable, and it is possible to optimize a discharge characteristic of droplets of the recording liquids from the nozzle holes 11A, 11B.

A flow of the recording liquids circulates in the order of the recording liquid supply passages 20A, 20B, the common supply passages 21A, 21B, the pressure chambers 18A, 18B, the communication passages 23A, 23B, the nozzle holes 11A, 11B, the return passages 25A, 25B, the common return passages 26A, 26B, and the recording liquid return passages 29A, 29B.

When supplying the recording liquids, by using a supply pump, or the like, the pressures in the recording liquid supply passages 20A, 20B are set higher than those in the recording liquid return passages 29A, 29B. And then, the recording liquids flow in the order of the recording liquid supply passages 20A, 20B, the common supply passages 21A, 21B, the pressure chambers 18A, 18B, the communication passages 23A, 23B, the return passages 25A, 25B, the common return passages 26A, 26B, and the recording liquid return passages 29A, 29B. Thus, filling of the recording liquids into the passages of droplet discharge head 10 is completed.

Additionally, when driving the piezoelectric elements 14A, 14B and discharging the recording liquids as droplets from the nozzle holes 11A, 11B, the pressures in the recording liquid supply passages 20A, 20B are set higher than those in the recording liquid return passages 29A, 29B. However, in this case, both are set lower than atmospheric pressure. Thus, negative pressures are always applied to the nozzle holes 11A, 11B statically. By maintaining the negative pressures around the nozzle holes 11A, 11B, meniscuses of the nozzle holes 11A, 11B can be hollow on sides of the pressure chambers 18A, 18B, respectively, and it is possible to suppress a discharge failure due to overflows of the recording liquids from the nozzle holes 11A, 11B, and the like.

The negative pressures are generated by, for example, a water head difference, using a meniscus holding power by a sponge in a tank, energizing a flexible wall provided in the tank by a spring, and so on. With such a structure, either when discharging droplets or not, the recording liquids in the pressure chambers 18A, 18B can always flow, and components in the recording liquids which are easy to deposit can also exist evenly in the recording liquids. Accordingly, it is possible to make the components exist in discharge droplets in desired amounts.

Additionally, according to the present example, the common return passages 26A, 26B are arranged below the common supply passages 21A, 21B, and both are formed in the passage-forming base plates 12. In a direction perpendicular to each of the pressure chambers 18A, 18B, the common supply passages 21A, 21B and the common return passages 26A, 26B are arranged on the same sides with respect to the corresponding pressure chambers 18A, 18B, respectively. That is, in the direction perpendicular to the pressure chambers 18A, the common supply passage 21A and the common return passage 26A are arranged on the same side with respect to the pressure chambers 18A, and in the direction perpendicular to the pressure chambers 18B, the common supply passage 21B and the common return passage 26B are arranged on the same side with respect to the pressure chambers 18B. With such a structure, compared to a case where the common supply passages 21A, 21B and the common return passages 26A, 26B are arranged at both ends of the pressure chambers 18A, 18B, respectively, the entire size of the droplet discharge head 10 can be smaller. Additionally, with such a structure, the passages of the recording liquids can be comparatively lengthened, and therefore, fluid resistance of the recording liquids increases. As a result, it is easy to limit a direction of the flow of the recording liquids when refilling to a direction from the common supply passages 21A, 21B to the pressure chambers 18A, 18B, which brings advantages of reduction of energy loss, prevention of a discharge failure due to superimposing refill vibrations.

Furthermore, the common supply passages 21A, 21B and the common return passages 26A, 26B are arranged in the same directions, respectively, and therefore, as shown in FIG. 1, it is possible to arrange the piezoelectric elements 14A, 14B in the center of a transverse direction of the droplet discharge head 10. The piezoelectric elements 14A, 14B, and the vibrating plate 13, and the pressure chambers 18A, 18B corresponding to those are required to be accurately bonded. In the present example, due to such a structure, a bonding process for the above can be reduced by half, compared to a case of bonding per line.

According to the present example, by circulating the recording liquids in the pressure chambers 18A, 18B, it is possible to agitate contents of the recording liquids, and miniaturize the entire droplet discharge head 10.

In addition, since the common supply passages 21A, 21B and the common return passages 26A, 26B are formed in the passage-forming base plate 12, it is possible to further miniaturize the droplet discharge head 10.

Additionally, since the passage-forming base plate 12 is formed of silicon, the common supply passages 21A, 21B, the pressure chambers 18A, 18B, the return passages 25A, 25B, and the common return passages 26A, 26B can be formed in one component. Therefore, it is possible to achieve a reduction of the number of components and assembling cost.

Furthermore, since the piezoelectric elements 14A, 14B are provided as the energy-generating elements, it is possible to achieve a droplet discharge head with a strong discharge force, and to be compatible with discharge of various recording liquids.

In a recording liquid, for example, materials easy to deposit such as titanium oxide which is a material of a white ink, cells, and so on are mixed, and when those materials deposit in a passage in the head, it is not possible to contain desired amounts of materials in droplets to be discharged from the nozzle holes 11A, 11B. However, in the droplet discharge head 10 of the present example, the recording liquids are circulated, and it is possible to prevent titanium oxide and cells from being deposited.

Note that in the present example, each of the supply holes 22A, 22B is provided approximately in the center of each of the common supply passages 21A, 21B, and each of the return holes 27A, 27B is provided at an end of one side (right end in FIG. 3) of each of the common return passages 26A, 26B; however, these are not limited to the above. For example, each of the supply holes 22A, 22B may be provided approximately in the center of each of the common supply passages 21A, 21B, and each of the return holes 27A, 27B may be provided at an end of the other side (left end in FIG. 3) of each of the common return passages 26A, 26B. Additionally, each of the supply holes 22A, 22B may be provided at an end of one side (right end in FIG. 2), or an end of the other side (left end in FIG. 2) of each of the common supply passages 21A, 21B, and each of the return holes 27A, 27B may be provided approximately in the center of each of the common return passages 26A, 26B.

Example 2

Figure 8:
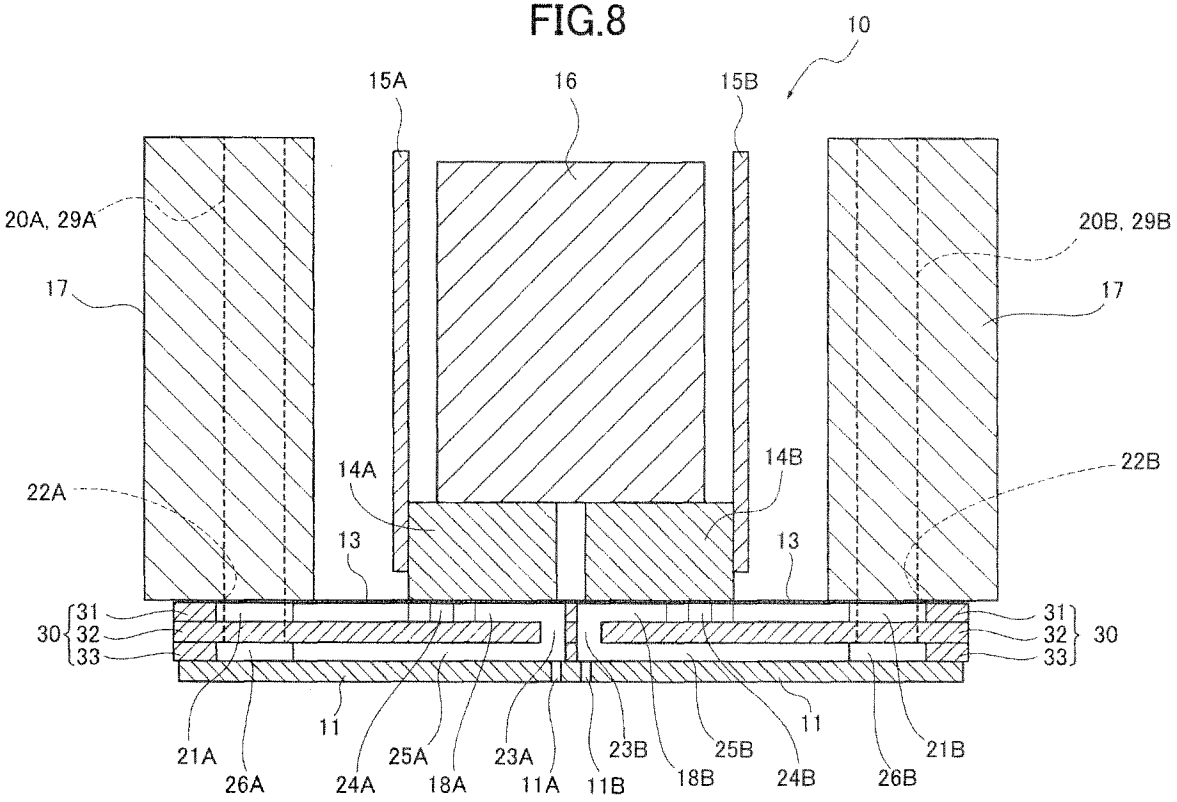
FIG. 8 is a longitudinal sectional view of a droplet discharge head of Example 2.

FIG. 8 shows Example 2. In the present example, a passage-forming base plate 30 is constituted of a layered structure of metal plates. That is, the passage-forming base plate 30 is constituted of three passage-forming plates 31, 32, 33 which are three SUS plates on which etching is performed by using an etchant such as ferric chloride, or the like.

In the passage-forming plate 31, the common supply passages 21A, 21B, the pressure chambers 18A, 18B having the narrow portions 24A, 24B, and the return holes 27A, 27B (see FIG. 2) are formed. In the passage-forming plate 32, the communication passages 23A, 23B, and the return holes 27A, 27B (see FIG. 7) are formed. Additionally, in the passage-forming plate 33, the return passages 25A, 25B and the common return passages 26A, 26B are formed.

Also in the present example, in the direction perpendicular to the pressure chambers 18A, the common supply passage 21A and the common return passage 26A are arranged on the same side with respect to the pressure chambers 18A, and in the direction perpendicular to the pressure chambers 18B, the common supply passage 21B and the common return passage 26B are arranged on the same side with respect the pressure chambers 18B.

With such a structure, and the housing 17 being formed of metal (for example, SUS), it is possible to achieve a droplet discharge head which is resistant to corrosion caused by a recording liquid, and therefore, it is possible to broaden options of a recording liquid. Other structures are the same as those in Example 1.

According to the present example, the passage-forming base plate 30 is constituted of the three passage-forming plates 31, 32, 33, which makes it possible to achieve a droplet discharge head resistant to various recording liquids, and therefore, it is possible to broaden options of a recording liquid.

Example 3

Figure 9:
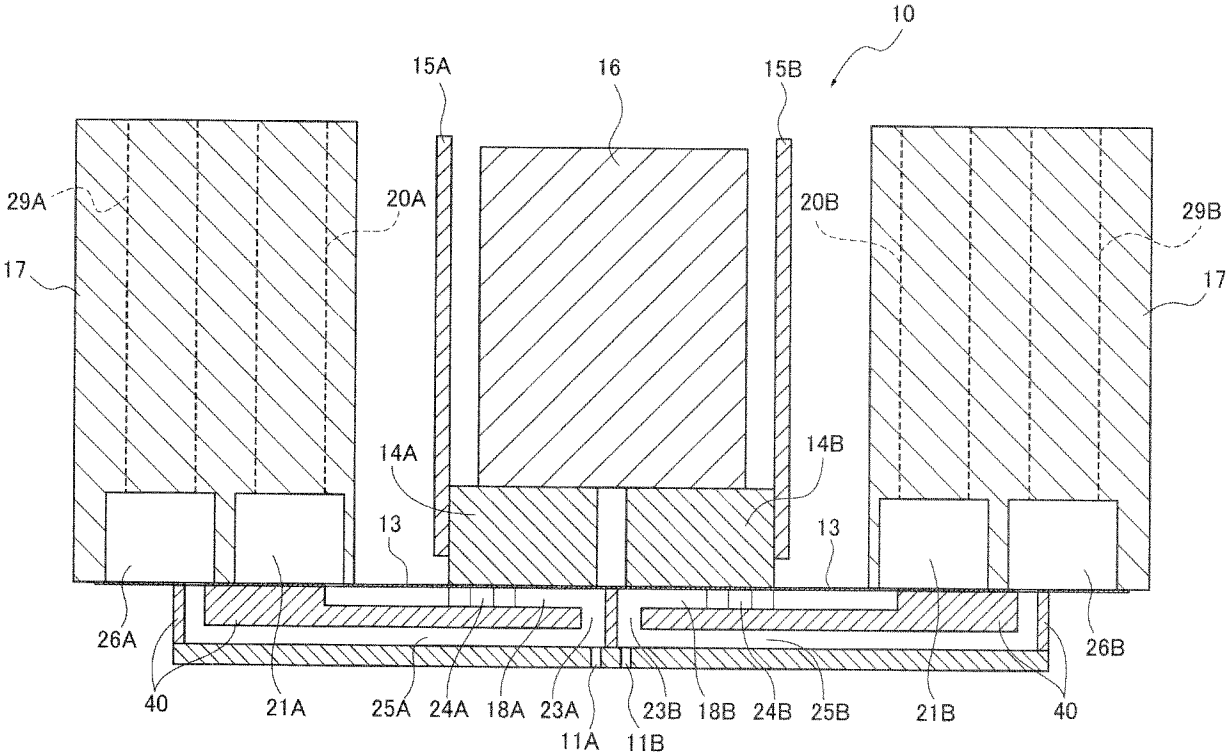
FIG. 9 is a longitudinal sectional view of a droplet discharge head of Example 3.

FIG. 9 shows Example 3. In the present example, the common supply passages 21A, 21B and the common return passages 26A, 26B are formed in the housing 17. On the other hand, in Examples 1 and 2, the common supply passages 21A, 21B and the common return passages 26A, 26B are formed in the passage-forming base plate 12. In the above structure in Examples 1 and 2, the height of the passage-forming base plate 12 is limited, and therefore, it is not possible to increase the heights (depths) of the common supply passages 21A, 21B, and the common return passages 26A, 26B.

However, when the heights of the common supply passages 21A, 21B are low, fluid resistance of recording liquids become larger. Therefore, for example, in a case of discharging recording liquids which are high in viscosity and large in amounts from the nozzle holes 11A, 11B at the same time, due to a difference between a pressure loss in the common supply passage 21A and a pressure loss in the common supply passage 21B, a difference in discharge characteristics of droplets of the recording liquids from the nozzle holes 11A, 11B occurs. That is, there is a possibility of an occurrence of a difference between a characteristic of droplets discharged from the nozzle holes 11A, 11B close to the center of the common supply passages 21A, 21B and a characteristic of droplets discharged from the nozzle holes 11A, 11B close to ends of the common supply passages 21A, 21B. In addition to the above, the pressure losses exceed surface tensions of the nozzle holes 11A, 11B, and there are possibilities of a discharge failure and no discharge.

In order to prevent such problems, in the present example, the common supply passages 21A, 21B and the common return passages 26A, 26B are formed in the housing 17 in which a relatively large capacity is easily ensured. With such a structure, it is possible to make fluid resistance of the recording liquids in the common supply passages 21A, 21B and the common return passages 26A, 26B smaller.

In the present example, a passage-forming base plate 40 is provided, and has the pressure chambers 18A, 18B having the narrow portions 24A, 24B, the communication passages 23A, 23B, and the return passages 25A, 25B. The return passages 25A, 25B directly communicate with the common return passages 26A, 26B, respectively. Other structures are the same as those in Example 1, and in particular, in the direction perpendicular to the pressure chambers 18A, the common supply passage 21A and the common return passage 26A are arranged on the same side with respect to the pressure chambers 18A, and in the direction perpendicular to the pressure chambers 18B, the common supply passage 21B and the common return passage 26B are arranged on the same side with respect to the pressure chambers 18B.

According to the present example, the common supply passages 21A, 21B and the common return passages 26A, 26B are formed in the housing 17, and therefore, fluid resistance of the entire passages becomes smaller, and it is possible to discharge recording liquids which are high in viscosity, and broaden options of a recording liquid.

Note that also in the present example, a structure of the passage-forming base plate 40 can be a layered structure of three metal plates as in Example 2.

Example 4

Figure 10:
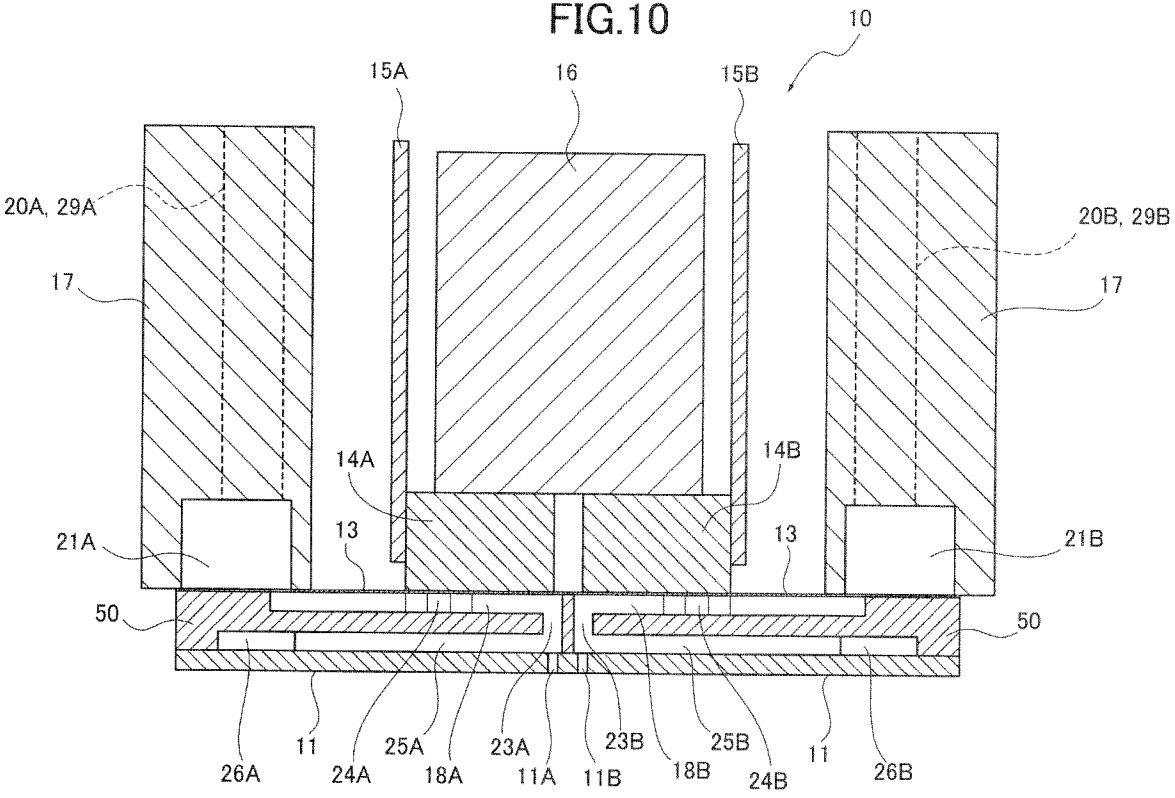
FIG. 10 is a longitudinal sectional view of a droplet discharge head of Example 4.

FIG. 10 shows Example 4. En the present example, the common supply passages 21A, 21B are formed in the housing 17, and the common return passages 26A, 26B are formed in a passage-forming base plate 50. The passage-forming base plate 50 has the pressure chambers 18A, 18B in which the narrow portions 24A, 24B are formed, the communication passages 23A, 23B, the return passages 25A, 25B, and the common return passages 26A, 26B.

Also in the present example, in the direction perpendicular to the pressure chambers 18A, the common supply passage 21A and the common return passage 26A are arranged on the same side with respect to the pressure chambers 18A, and in the direction perpendicular to the pressure chambers 18B, the common supply passage 21B and the common return passage 26B are arranged on the same side with respect to the pressure chambers 18B.

With such a structure, the common supply passages 21A, 21B are formed not in the passage-forming base plate 50 but in the housing 17, and therefore, it is possible to make fluid resistance of recording liquids in the common supply passages 21A, 21B small, and make the size of the entire droplet discharge head 10 smaller.

Note that contrary to the above, the common return passages 26A, 26B may be formed in the housing 17, and the common supply passages 21A, 21B may be formed in the passage-forming base plate 50.

According to the present example, the common supply passages 21A, 21B are formed in the housing 17, and therefore, it is possible to secure large passage areas of the common supply passages 21A, 21B. As a result, fluid resistance in the common supply passages 21A, 21B becomes smaller, and it is possible to discharge recording liquids which are high in viscosity, and broaden options of a recording liquid.

Additionally, the common return passages 26A, 26B are formed in the passage-forming base plate 50, and therefore, it is possible to keep fluid resistance in the common return passages 26A, 26B low, and miniaturize the droplet discharge head 10.

Note that also in the present example, a structure of the passage-forming base plate 50 can be a layered structure of three metal plates as in Example 2.

Example 5

Figure 11:
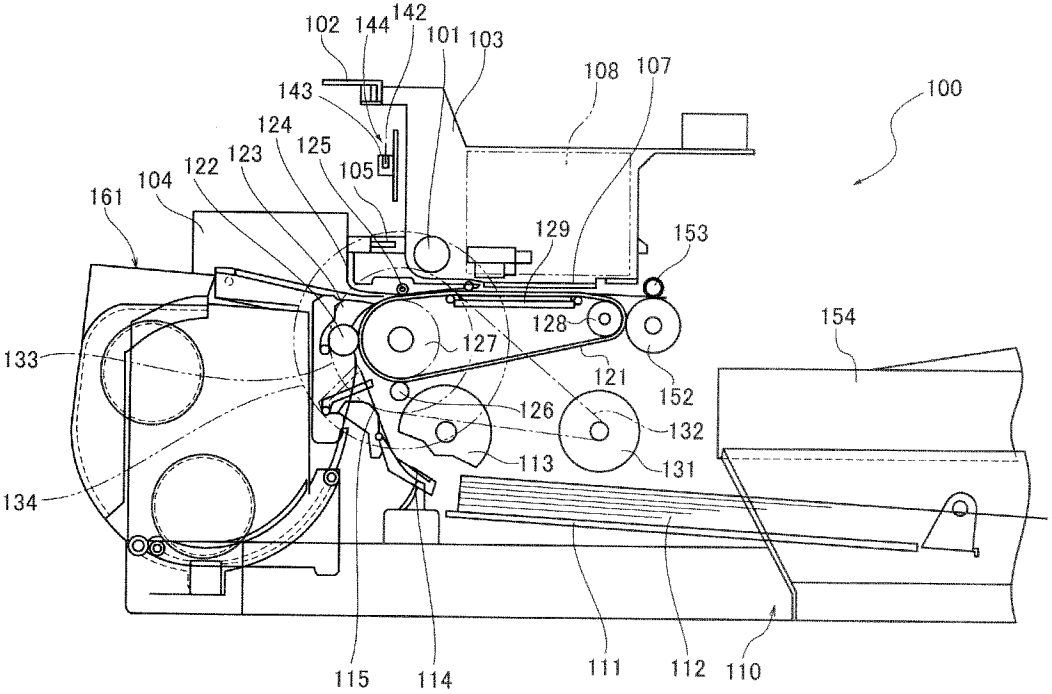
FIG. 11 is a view showing a structure of an image-forming apparatus of Example 5 equipped with the droplet discharge head of any one of Examples 1 to 4.
Figure 12:
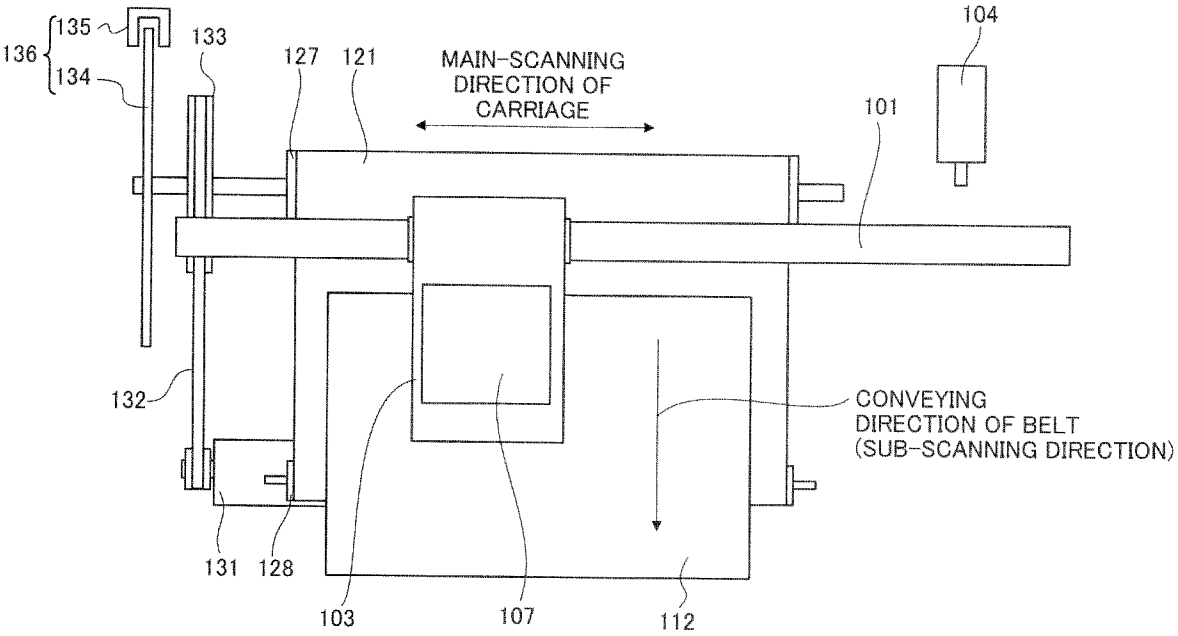
FIG. 12 is a plan view showing a main part of the image-forming apparatus in FIG. 11.

FIGS. 11 and 12 show Example 5. In the present example, an image-forming apparatus 10 with which the droplet discharge head 100 of any one of Examples 1 to 4 is equipped is described. Note that FIG. 11 shows a view of an entire structure of the image-forming apparatus 100 as seen from the side, and FIG. 12 shows a main part of the image-forming apparatus 100.

In the image-forming apparatus 100, on a front side and a rear side in FIG. 11, side plates (not shown) are provided, respectively, and between the side plates, a guide rod 101 and a guide rail 102 are provided so as to extend. A carriage 103 is supported so as to be freely slidable by the guide rod 101 and the guide rail 102. By transmitting a rotating force of a main-scanning motor 104 via a timing belt 105, the carriage 103 slides in a right and left direction (a main-scanning direction of the carriage 103) shown by an arrow in FIG. 12 along the guide rod 101 and the guide rail 102.

In the carriage 103, for example, four recording heads 107 which discharge ink droplets of yellow (Y), cyan (C), magenta (M), and black (Bk) colors, respectively, are provided.

The recording heads 107 are mounted such that a plurality of ink discharge ports are arranged in a direction intersecting the main-scanning direction, and a discharge direction of the ink droplets faces downward. Note that each of the recording heads 107 is the same as the droplet discharge head 10 described in any one of Examples 1 to 4, and a piezoelectric actuator such as a piezoelectric element, or the like is included.

A sub tank 108 for supplying each color ink to each of the recording heads 107 is included in the carriage 103. The ink is replenished from a main tank (ink cartridge) via an ink supply tube (not shown), and supplied to the sub tank 108.

Below the image-forming apparatus 100, a paper-feeding cassette 110 is provided, and on a paper-loading part (pressure plate) 111 of the paper-feeding cassette 110, or the like, sheets of paper 112 are loaded. In the vicinity of an end of the paper-loading part 111, a paper-feeding roller (semicircular roller) 113, and a separate pad 114, which faces the paper-feeding roller 113, are provided. The separate pad 114 is formed of a material having a large friction coefficient, and energized on a side of the paper-feeding roller 113. And the paper-feeding roller 113 separates sheets of paper 112 one by one from the paper-loading part 111, and the separated sheets of paper 112 are fed to a guide 115 which is provided by connecting to the separate pad 114.

The sheets of paper 112 fed to the guide 115 are sent to a conveying belt 121 via a counter roller 122 and a conveying guide 123. The counter roller 122 is used for holding and conveying the sheets of paper 112 fed to the guide 115 between the counter roller 122 and the conveying belt 121. The conveying guide 123 is used for changing a direction of the sheets of paper 112 sent approximately vertically upward between the counter roller 122 and the conveying belt 121 by approximately 90 degrees to be followed on the conveying belt 121. Additionally, an end pressurizing roller 125 which is energized on a side of the conveying belt 121 by a pressing member 124, and a charging roller 126 which charges a surface of the conveying belt 121 are provided. Note that the conveying belt 121 electrostatically attracts sheets of paper 112 and conveys them.

The conveying belt 121 is an endless belt, and extends between a conveying roller 127 and a tension roller 128. The conveying belt 121 moves around in a belt conveying direction (sub-scanning direction) in FIG. 12, by rotating the conveying roller 127 via a timing belt 132 and a timing roller 133 by a sub-scanning motor 131. Note that on a side of a reverse surface of the conveying belt 121, a guide member 129 is arranged corresponding to an image-forming area by the recording heads 107.

Additionally, as shown in FIG. 11, to a shaft of the conveying roller 127, a slit disk 134 is attached, and a slit of the slit disk 134 is detected by a sensor 135 (see FIG. 12).

A rotation amount of the conveying roller 127 (a moving amount of the conveying belt 121) can be thus detected. Note that the slit disk 134 and the sensor 135 constitute an encoder 136.

The charging roller 126 is arranged to be in contact with a surface layer of the conveying belt 121, and to rotate to follow a rotational movement of the conveying belt 121. To both ends of a shaft of the charging roller 126, a pressurizing force of 2.5 N is applied.

Additionally, as shown in FIG. 11, on a front side of the carriage 103, an encoder scale 142 in which a slit is formed is provided, and on a side of a front surface of the carriage 103, an encoder sensor 143 constituted of a transmission-type photo sensor which detects the slit is provided. The encoder scale 142 and encoder sensor 143 constitute an encoder 144 which detects a position in the main-scanning direction of the carriage 103 (a position with respect to a home position).

Furthermore, in order to discharge the sheets of paper 112 recorded by the recording heads 107, a separator which separates sheets of paper 112 from the conveying belt 121, a first paper discharge roller 152, a second paper discharge roller 153, and a paper discharge tray 154 which stocks the discharged sheets of paper 112 are provided.

Additionally, in a rear part (left side in the drawing) of the image-forming apparatus 100, a double-sided paper-feeding unit 161 is mounted to be freely attachable and detachable. The double-sided paper-feeding unit 61 loads and reverses the sheets of paper 112 which are returned by rotation in an opposite direction of the conveying belt 121, and again feeds them between the counter roller 122 and the conveying belt 121.

In the thus configured image-forming apparatus 100, sheets of paper 112 are separated and fed one by one from the paper-loading part 111, and the sheets of paper 112 fed appropriately vertically upward are guided by the guide 115, and held between the conveying belt 121 and the counter roller 122 and conveyed. Additionally, an end of the sheets of paper 112 is guided by the conveying guide 123, and the sheets of paper 112 are pressed to the conveying belt 121 by the end pressurizing roller 125, and changed in a conveying direction by approximately 90 degrees.

At this time, from a high-voltage power supply of a control circuit (not shown), a positive output and a negative output are alternately applied to the charging roller 126 repeatedly, that is, alternating voltages are applied to the charging roller 126. The conveying belt 121 is charged in an alternating charged voltage pattern, that is, the conveying belt 121 is alternately charged positively and negatively in a belt-like shape having a predetermined width in the sub-scanning direction as a rotational direction. When sheets of paper 112 are fed on the conveying belt 121 which is alternately charged positively and negatively, the sheets of paper 112 are attracted by an electrostatic force, and conveyed in the sub-scanning direction by the rotational movement of the conveying belt 121.

Then, by driving the recording heads 107 in accordance with an image signal with moving the carriage 103, ink droplets are discharged and recording is performed for one line on sheets of paper 112 being stopped, and after conveying the sheets of paper 112 by a predetermined amount, recording for a next line is performed. By receiving an end-of-recording signal, or a signal which informs that a rear end of the sheets of paper 112 reaches a recording area, the recording ends and the recorded sheets of paper 112 are discharged to the paper discharge tray 154.

Additionally, in a case of double-sided printing, when recording on a front surface (a surface on which printing is firstly performed) ends, by rotating the conveying belt 121 in the opposite direction, single-sided recorded sheets of paper 112 are sent to the double-sided paper-feeding unit 161. In the double-sided paper-feeding unit 161, the single-sided recorded sheets of paper 112 are reversed (a rear surface is a surface to be printed), and fed between the counter roller 122 and the conveying belt 121 again. Then, timing control is performed, and as described above, after the single-sided recorded sheets of paper 112 are conveyed on the conveying belt 121 and recording is performed on the rear surface, the double-sided recorded sheets of paper 112 are discharged to the paper discharge tray 154.

According to the present example, it is possible to obtain a compact image-forming apparatus with high reliability.

Additionally, for example, the image-forming apparatus 100 can be applied to a printer, a fax machine, a copier, and a multifunction peripheral thereof.

Furthermore, the embodiments of the present invention can be applied as a droplet discharge head and a droplet discharger, which discharge liquid other than ink, for example, a DNA sample, a resist, a pattern material, or the like, or as an image-forming apparatus including those.

According to the embodiment of the present invention, the common supply passages and the common return passages are arranged on the same sides with respect to the corresponding pressure chambers, respectively, in the direction perpendicular to each of the pressure chambers, and therefore, it is possible to suppress enlargement of a droplet discharge head in a direction along the pressure chambers. As a result, it is possible to prevent a droplet discharge head which is a type in which a circulation flow of liquid is generated in a pressure chamber from becoming larger. And additionally, it is possible to obtain a highly-reliable and compact image-forming apparatus equipped with the droplet discharge head.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A droplet discharge head, comprising:

a plurality of pressure chambers which communicate with a plurality of nozzles which discharge droplets, respectively, in a droplet discharge direction;

at least one common supply passage which supplies liquid to the pressure chambers;

at least one common return passage which communicates with the pressure chambers and to which a part of the liquid in the pressure chambers is returned; and a plurality of energy-generating elements which generate pressure in the pressure chambers, wherein the droplet discharge head circulates liquid supplied from the common supply passage to the pressure chambers to the common return passage and discharges droplets from the nozzles when pressure is generated in the pressure chambers by the energy-generating elements, wherein the common supply passage and the common return passage are arranged on the same side with respect to the pressure chambers, and wherein the at least one common return passage is disposed below the at least one common supply passage in the droplet discharge direction.

2. The droplet discharge head according to claim 1, wherein at least pairs of pressure chambers, common supply passages, common return passages, energy-generating elements, and nozzles are provided, and the energy-generating elements are arranged between the common supply passages and the common return passages in passages along a flow of the liquid.

3. The droplet discharge head according to claim 1, wherein the common supply passage and the common return passage are formed in a passage-forming base plate in which the pressure chambers are formed.

4. The droplet discharge head according to claim 3, wherein the pressure chambers are communicated with the common return passage via return passages provided per pressure chamber, and the return passages are formed in the passage-forming base plate in which the common supply passage and the common return passage are formed.

5. The droplet discharge head according to claim 3, wherein the passage-forming base plate is formed of silicon.

6. The droplet discharge head according to claim 3, wherein the passage-forming base plate is formed of a layered structure of metal plates.

7. The droplet discharge head according to claim 1, wherein a housing which holds a passage-forming base plate in which the pressure chambers are formed is provided, and the common supply passage and the common return passage are formed in the housing.

8. The droplet discharge head according to claim 1, wherein a housing which holds a passage-forming base plate in which the pressure chambers are formed is provided, the common supply passage is formed in the housing, and the common return passage is formed in the passage-forming base plate.

9. The droplet discharge head according to claim 1, wherein a housing which holds a passage-forming base plate in which the pressure chambers are formed is provided, the common supply passage is formed in the passage-forming base plate, and the common return passage is formed in the housing.

10. An image-forming apparatus comprising the droplet discharge head according to claim 1.

* * * * *